US006014448A

United States Patent [19]

Alton, Jr.

[11] Patent Number: 6,014,448

[45] **Date of Patent: *Jan. 11, 2000**

[54] FLUID COUPLED SUBWOOFER ACOUSTIC ENCLOSURE SYSTEM

[75] Inventor: Noyal J. Alton, Jr., Virginia Beach, Va.

[73] Assignee: Sound Related Technologies, Virginia Beach, Va.

[ * ] Notice: This patent is subject to a terminal disclaimer.

[21] Appl. No.: 08/964,529

[22] Filed: Nov. 5, 1997

Related U.S. Application Data

[60] Provisional application No. 60/046,354, May 13, 1997.

[51] Int. Cl.[7] ..... H04R 25/00

[52] U.S. Cl. ..... 381/351; 381/354

[58] Field of Search ..... 381/89, 345, 353, 381/354, 182, 186, 349, 351; 181/144, 145, 146, 151, 199

[56] References Cited

U.S. PATENT DOCUMENTS 4,004,094 1/1977 Ott .
4,101,736 7/1978 Czerwinski .
4,356,882 11/1982 Allen .
4,944,019 7/1990 Watanabe .
5,073,937 12/1991 Almasy .

*Primary Examiner*—Paul Loomis
*Assistant Examiner*—Dionne N. Harvey
*Attorney, Agent, or Firm*—Kaufman & Canoles

[57] ABSTRACT

An acoustic enclosure system for a loudspeaker includes a central chamber and two end chambers. The central chamber is separated from each of the end chambers by a common wall. Two loudspeakers are mounted in the central chamber such that one speaker is mounted in each of the horizontal walls and the speakers face away from each other. The central chamber has a port in a side wall that is open to the outside of the enclosure. Each of the end chambers contains a fluid chamber with a flexible bladder that is filled with fluid and maintained in the end chamber a given distance from the corresponding loudspeaker. Each of the bladders contacts the interior surfaces of the side walls and end piece that form the fluid chamber. A flexible support is provided underneath each of the bladders so that the bladders are each substantially maintained a specified distance from the horizontal walls.

8 Claims, 2 Drawing Sheets

FLUID COUPLED SUBWOOFER ACOUSTIC ENCLOSURE SYSTEM

This application claims the benefit of U.S. Provisional Application No: 60/046,354.

BACKGROUND OF THE INVENTION

The invention relates to loudspeaker enclosures and more particularly to a fluid damped acoustic enclosure system.

As disclosed in U.S. Pat. No. 5,281,777 issued to Alton, Jr., the contents of which are incorporated herein by reference, a loudspeaker vibrating in isolation produces very little sound. The reason for this is that the waves formed in the front and back of the speaker can effectively cancel each other out. When the loudspeaker's cone is thrust forward, a high-pressure compression is formed in the front and a low pressure rarefaction is formed in the back of the cone. If the wavelength of the sound is large compared to the dimensions of the loudspeaker, an air flow will be set up between the high-pressure and low-pressure regions with the result that the sound intensity is substantially reduced.

To prevent such reduction in sound intensity, a loudspeaker may be mounted in a baffle. The baffle prevents the air in front from communicating with the air in back of the speaker. A baffle is effective as long as the resulting path length between the front and back of the speaker is greater than the wavelength of the sound. In other words, the time required for a disturbance to travel from the front to the back must be greater than one period of the cone's motion.

Loudspeakers however, are not normally mounted in baffles. Typically, loudspeakers are mounted in an enclosure. While such an arrangement prevents the transport of air from the front to the back of the loudspeaker, other problems arise that are related to low frequency audio reproduction. With respect to low frequency audio (1–150 Hertz), the human ear cannot generally detect audio signals below approximately 20 Hz. Yet, the vibrating sensations felt by audio signals below 20 Hz that are typically present during a live performance enhance the listening experience. However, even the best low frequency speaker systems, or sub-woofers as they are known, are only able to efficiently reproduce low frequency signals down to about 15 Hz and generally require a great deal of power to do so.

SUMMARY OF THE INVENTION

Accordingly, it s an object of the present invention to provide an acoustic speaker system that efficiently reproduces low frequency audio signals.

Another object of the present invention is to provide an acoustic speaker system whose low frequency or bass response closely simulates that of actual instrumental tones.

Still another object of the present invention is to provide an acoustic speaker system that efficiently reproduces audio signals below 15 Hz.

Other objects and advantages of the present invention will become more obvious hereinafter in the specification and drawings.

In accordance with the present invention, an acoustic enclosure system for a loudspeaker is provided which includes a central chamber and two end chambers. The central chamber is separated from each of the end chambers by a common horizontal wall. Two loudspeakers are sealably mounted in the central chamber such that one speaker is mounted in each of the horizontal walls and the speakers face away from each other. The central chamber has a port in a side wall that is open to the outside of the enclosure. Each of the end chambers is airtight and contains a fluid chamber with a flexible bladder that is filled with fluid and maintained in the end chamber at a given distance from the corresponding loudspeaker. The flexible bladders receive acoustic pressure waves generated by the loudspeakers. Each of the bladders contacts the interior surfaces of the side walls and end piece that form the fluid chamber. A flexible support is provided underneath each of the bladders so that the bladders are each substantially maintained a distance L from the respective horizontal walls.

This enclosure system produces 1½ times the vibrational effect over a single speaker design. In addition, smoothing of the bass waveform and more accurate definition of the waveform are achieved, which make the output stronger in the tactile response on the body and deliver a much smoother tone.

DETAILED DESCRIPTION OF THE INVENTION

Figure 1:
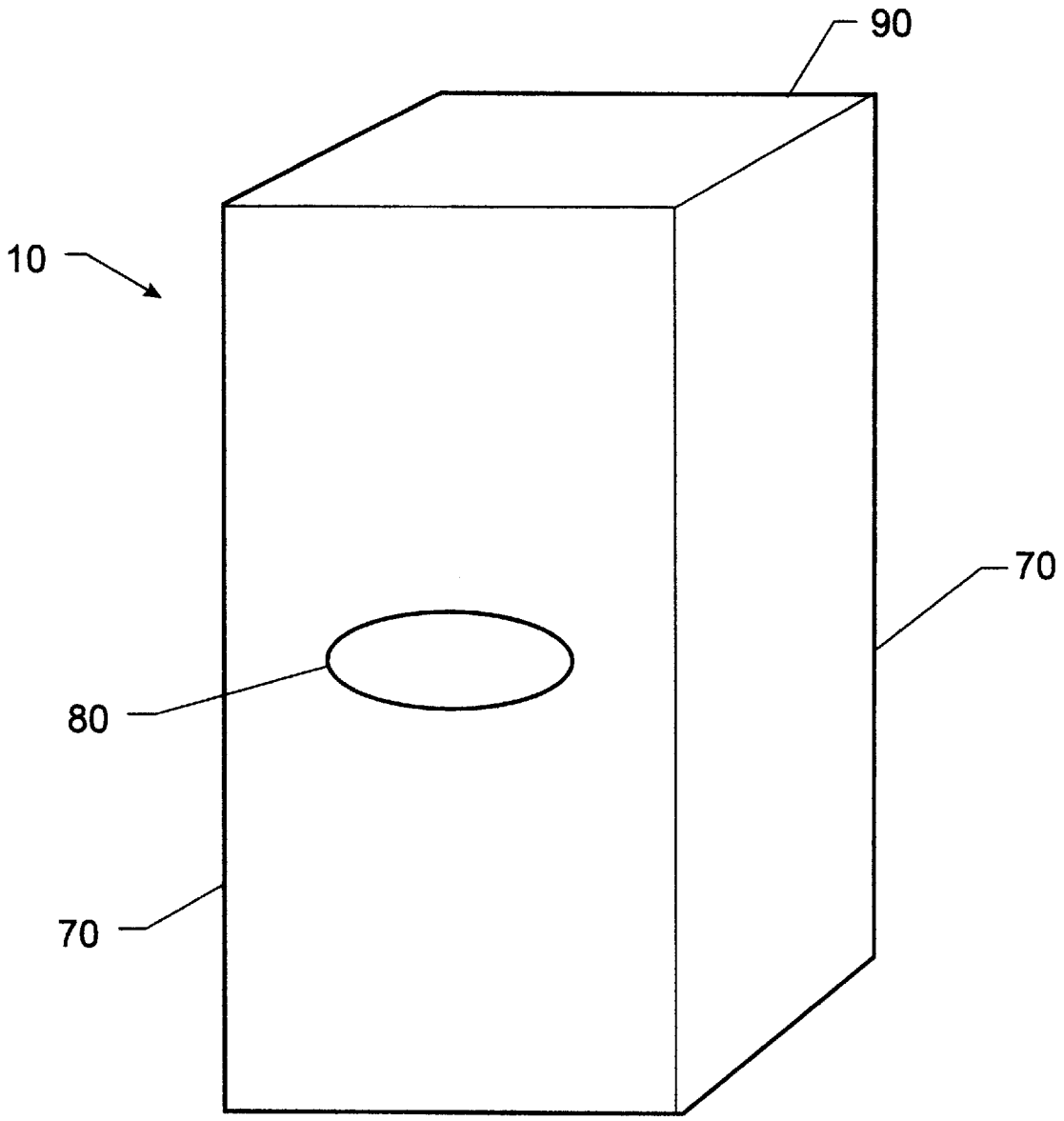
FIG. 1 is perspective view of an acoustic enclosure according to a preferred embodiment of the invention.
Figure 2:
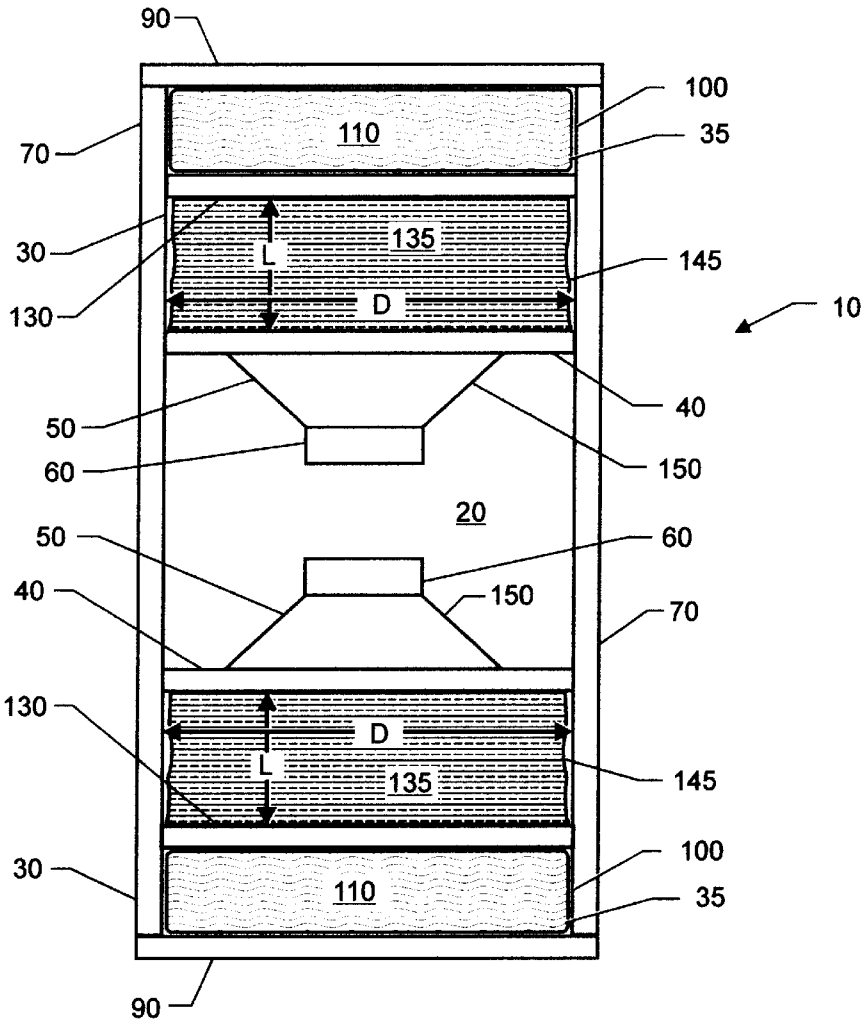
FIG. 2 is a cross sectional view of the acoustic enclosure of FIG. 1.

As shown in FIGS. 1 and 2, an improved acoustic enclosure system 10 includes a central chamber 20 and two end chambers 30. The central chamber is separated from each of the end chamber by horizontal walls 40. Two loudspeakers 50 are mounted in the central chamber, one in each of the horizontal walls 40 such that each speaker is positioned over a corresponding opening (not shown) in the horizontal wall 40. The speakers 50 are oriented to face away from each other and are preferably spaced apart a distance sufficient to permit the magnetic fields of the facing magnets 60 on the backside of the speakers 50 to combine energy to enhance the motor operations of both speakers 50. In this orientation, the speakers 50 radiate into respective end chambers 30. The speakers 50 may be spaced at varying distances, but the operation of the speaker motors will not be optimized.

The size of the central chamber 20 can be selected to accommodate optimum distancing of the speaker magnets 60, or it can be designed by referring to published industry standards for speaker enclosures. The loudspeakers 50 can be any conventional low frequency dynamic loudspeakers or woofers, the choice of which is not a limitation on the present invention.

The central 20 and end chambers 30 are further defined by side walls 70 which act as the sound/vibration delivery mechanism (i.e., diaphragm). The side walls 70 may be continuous or segmented. However, the continuous side wall 70 generally provides a more continuous waveform than an enclosure having a segmented side wall. If a segmented side wall is used, it should be designed to continue the development of the waveform. At least one port 80 is disposed in an area of the side wall defining the central chamber 20.

The end chambers 30 are further defined by end pieces 90 that contain the vibrations in the sense that they assist in directing vibrations to the side walls 70. Thus, the entire enclosure cooperates to act as a diaphragm to deliver a signal source.

The end chambers 30 further include a fluid chamber 35 which houses a flexible bladder 100 a distance L above loudspeaker 50. Bladders 100 are filled with a liquid 110 via valve (not shown). Once filled, bladders 100 may be permanently sealed and installed in their respective end chambers 30. Alternatively, the valve may be a resealable valve and the bladder 100 may be removable with respect to the end chamber 30 to facilitate the filling and emptying of the bladder 100. The liquid 110 is selected such that it remains in its liquid phase throughout the range of expected operating temperatures of the system 10. For most purposes, the liquid 110 may be water. However, if operation of the system 10 at colder temperatures is required, salt water or water with an antifreeze additive may be appropriate. Conversely, at extremely high temperatures, a water/coolant mixture may be required to prevent boiling. The amount of water or mixture thereof used to fill bladder 100 is approximately equal to one gallon of liquid for every 2" of loudspeaker diameter D. For example, if loudspeaker 50 has an 18" diameter, 9 gallons of liquid 110 are required to fill bladder 100.

Figure 3:
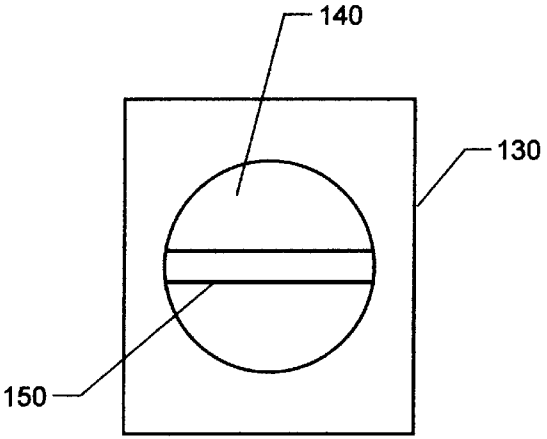
FIG. 3 is a plan view of one embodiment of a bladder support.

Bladder 100 is supported and maintained at the height L above loudspeaker 50 by a flexible wall 130 that is fixed to and supported at the side walls 70 of the enclosure and further defines the fluid chamber 35. To simplify the discussion and analysis of the present invention, it will be assumed that the flexible wall 130 is generally horizontal such that L is substantially constant. As shown in FIG. 3, flexible wall 130 is designed with an opening 140 spanned by a crossbar 150 to allow sound pressure generated by loudspeaker 50 to pass therethrough.

As each bladder 100 is filled, it expands to substantially fully contact the interior of the fluid chamber 35. The bladder 100 is filled so that the fluid contents are under a pressure of about 2–3 psi. Since the bladder 100 is installed from the top of the enclosure, the end piece 90 is generally a removable part of the enclosure that may be sealed in place by any conventional means. If the bladders 100 are to be emptied and filled from time to time, the valve may be resealable and extend through and be sealed in one of the side walls 70 or through the respective end piece 90.

The spaces between the horizontal walls 40 and the flexible walls 130 act as compression chambers 135 and are sized to about 75% of industry recommended standards. Although industry standards may be used to size the compression chambers 135, such chambers 135 would have decreased output and decreased tactile delivery, since higher pressure in the compression chamber 135 results in more interaction of the liquid with the exterior walls. The compression chambers 135 are preferably insulated at the interior of the side walls 70 using about ¾ inch speaker enclosure insulation 145. Although the compression chambers may also be uninsulated, the insulation 145 has the beneficial effect of decreasing the air compression on the side walls 70 so the fluid vibrational effect on the side walls 70 is more effectively used. The use of insulation 145 reduces the phase and frequency interference at the side walls 70 of the compression chambers 135 that arise as a result of vibrations delivered through both the compression chambers 135 and the fluid chambers 35. Thus, the vibrational effect on the side walls 70 effectively comes from the fluid chamber 35 and not the compression chamber 135.

In operation, the flexible cone 150 of each loudspeaker 50 generates sound pressure waves of equal and opposite magnitude into both the central chamber 20 and the respective adjacent end chamber 30. With respect to each end chambers 30, the waves impinge upon and pass through the flexible wall 130 through the opening 140. The underside of each bladder 100 receives the waves and transmits them through the liquid 110. The waves propagate through the liquid 110 and are coupled to the side walls 70 and end pieces 90. In this way, sound waves are coupled to relatively rigid radiating surfaces, namely, the enclosure. Since each pressurized bladder 100 is in full contact with the side walls 70 and a respective end piece 90, there is improved tactile delivery, i.e., the vibrational portion of the signal is more effectively delivered. It has also been found that heating the liquid 110 increases the effective delivery of the vibrational portion of the signal.

Typically, a portion of each pressure wave is simultaneously reflected back towards its source, i.e., speaker 50, causing a reflective damping effect in the area of each of the end chambers 90 below flexible wall 130 and on cone 150. In order to prevent the occurrence of the reflective wave, a fluid dampening material, such as a dacron polyester material as provided in the Wave Reduction Waterbed System™ available from Vinyl Products, Carson City, Nev. may be added to the fluid.

It is to be understood that the aforedescribed invention will apply to a variety of enclosure shapes and materials used therefore. For example, the enclosure might be cylindrical, rectangular, octagonal, etc. The size of the enclosure may vary, as well as the relative dimensions of the various chambers. For illustrative purposes only, the dimensions of a representative acoustic enclosure will be described. As an example, an enclosure 10 which is about 49½ inches high and 24¼ inches deep and wide may have a central chamber 20 that is about 15 15/16 inches high, compression chambers 135 that are about 7½ inches high, and fluid chambers 35 that are about 7 inches high.

The enclosure is rigidly constructed from a dense material that is typically screwed and glued together. For best radiating characteristics, the material used to construct the enclosure is a birch or oak plywood, since these materials have low enough resonances and high density. Medium density fiberboard has also been found to be suitable; however, other materials may be used as long as the harmonic resonance of the material is low enough to resonate at the desired low frequencies.

The flexible wall 130 must be strong enough to support the fluid-filled bladder 100 and yet flex as part of a complex spring system that includes the fluid-filled bladder 100 and loudspeaker cone 150. The flexible wall 130 may have openings with alternate configurations such as a plurality of circular perforations which allow the passage of pressure waves as described above. While the shape and arrangement of any openings or perforations should be such that the structural integrity of flexible wall 130 is not jeopardized, the specifics relating to openings or perforations and their arrangement are not a limitation on the present invention.

The bladder 100 may be constructed from any flexible, liquid-impermeable material such as polyvinyl or rubber. Dimensions of the bladder 100 are selected such that when the required amount of liquid fills same, the bladder 100 contacts the entire interior surfaces of the fluid chamber 35. Although the invention has been described with reference to the use of a bladder 100 to hold the liquid 110, it should be understood that the bladder 100 functions to hold the pressured liquid while fully contacting the interior surfaces of the fluid chamber 35. In addition, the surface of the bladder 100 facing the loudspeaker 50 should be exposed to receive pressure waves from the speaker 50. Thus, it is possible that alternate embodiments of the invention may use other fluidcontaining means. For example, a flexible, semi-rigid material may be used to line the interior of the side walls and end pieces and extend across the inside of the enclosure to form the fluid chamber such that it may be unnecessary to support the fluid chamber with a horizontal wall. In this way, the fluid chamber itself acts a the "bladder" and holds the fluid.

The advantages of the present invention are numerous. The acoustic enclosure system described herein efficiently reproduces audible and subaudible frequencies from 6–150 Hz. Further, by producing a range of resonant frequencies centered about each point resonant frequency, a full low frequency response is achieved

What is claimed is:

1. An acoustic enclosure system for a loudspeaker comprising:

an enclosure having at least one side wall and two end pieces, said enclosure defining a central chamber between two end chambers, wherein each end chamber is separated from the central chamber by a speaker wall, said central chamber having a port in the at least one side wall thereof communicating with the exterior of said enclosure;

two loudspeakers, each of said loudspeakers being sealably mounted in a respective speaker wall such that each loudspeaker faces into an end chamber and the loudspeakers face in opposite directions; and each end chamber having a fluid chamber spaced a distance from the loudspeaker, wherein said fluid chamber contains fluid and is substantially in full contact with the at least one side wall and the end piece.

2. The acoustic enclosure system of claim 1, wherein the fluid is under pressure.

3. The acoustic enclosure system of claim 2, wherein each fluid chamber further comprises a flexible bladder, each of said flexible bladders holding fluid and being in substantially full contact with the at least one side wall and the corresponding end piece.

4. The acoustic enclosure system of claim 3, wherein each end chamber further comprises a flexible wall having at least one opening, each of said flexible walls being fixed to the at least one side wall and positioned between a flexible bladder and a speaker to support the fluid chambers a desired distance from a corresponding speaker, wherein the at least one side wall, the speaker wall and the flexible wall define a compression chamber.

5. The acoustic enclosure system of claim 4, further comprising insulation disposed at the interior of the at least one side wall in each of the compression chambers.

6. The acoustic enclosure system of claim 5, wherein the speakers are spaced to optimize motor operations of the speakers.

7. The acoustic enclosure system of claim 6, further comprising a fluid dampening material in the fluid.

8. The acoustic enclosure system of claim 7, further comprising at least four side walls, wherein said side walls and the end pieces are wood capable of resonating at specified low frequencies.

* * * * *